US005795709A

United States Patent [19]

Adegawa et al.

[11] Patent Number: 5,795,709

[45] Date of Patent: Aug. 18, 1998

[54] PARTICULATE PHOTOGRAPHIC POLYMER

[75] Inventors: Yutaka Adegawa; Kentaro Shiratsuchi, both of Minami-ashigara, Japan

[73] Assignee: Fuji Photo Film Co., Ltd., Kanagawa, Japan

[21] Appl. No.: 821,075

[22] Filed: Mar. 20, 1997

[30] Foreign Application Priority Data

Mar. 29, 1996 [JP] Japan ..... 8-104096

[51] Int. Cl.[6] ..... G03C 1/32

[52] U.S. Cl. ..... 430/627; 430/531; 430/950

[58] Field of Search ..... 430/627, 531, 430/950

[56] References Cited

U.S. PATENT DOCUMENTS

| | | | |
|---|---|---|---|
| 4,201,589 | 5/1980 | Sakaguchi et al. | 430/627 |
| 4,245,036 | 1/1981 | De Winter et al. | 430/627 |
| 4,358,533 | 11/1982 | Tokitou et al. | 430/627 |
| 4,366,238 | 12/1982 | Yokoyama et al. | 430/627 |
| 4,495,275 | 1/1985 | Yokoyama et al. | 430/627 |
| 4,722,885 | 2/1988 | Yokoyama et al. | 430/627 |
| 5,242,787 | 9/1993 | Yamada et al. | 430/627 |
| 5,362,613 | 11/1994 | Shiratsuchi et al. | 430/627 |
| 5,380,637 | 1/1995 | Yamashita et al. | 430/627 |
| 5,587,287 | 12/1996 | Saitou et al. | 430/627 |
| 5,595,863 | 1/1997 | Yamanouchi et al. | 430/627 |

FOREIGN PATENT DOCUMENTS

| | | |
|---|---|---|
| A-0610522 | 8/1994 | European Pat. Off. . |
| A-0618490 | 10/1994 | European Pat. Off. . |
| A61-230141 | 10/1986 | Japan . |

*Primary Examiner*—Hoa Van Le

*Attorney, Agent, or Firm*—Sughrue, Mion, Zinn, Macpeak & Seas, PLLC

[57] ABSTRACT

There is disclosed a particulate photographic polymer, which at least comprises a repeating unit of the formula (I):

Formula (I)

wherein R is an alkyl group, a phenyl group, or a hydrogen atom; L is a divalent organic binding group; A is a repeating unit derived from at least one ethylenically unsaturated monomer, or a repeating unit derived by ring opening polymerization of a nitrogen-containing heterocyclic compound, with $-(A)_m-$ being soluble in water or a hydrophilic organic liquid; m is from 2 to 200; and Y is a monovalent binding group. The polymer is excellent in dispersion stability in coating solutions, prevents settling and agglomeratingis and the formation of mat pinholes, and can improve granularity of images.

18 Claims, No Drawings

PARTICULATE PHOTOGRAPHIC POLYMER

FIELD OF THE INVENTION

The present invention relates to a particulate photographic polymer that is excellent in dispersion stability in a coating solution, in preventing the occurring of mat pinholes after coating, and in improving the graininess (granularity) of images.

BACKGROUND OF THE INVENTION

Particulate photographic polymers have important functions to be used, for example, for the purpose of preventing adhesion, static marks, or scratches, which will be formed when the surface protective layer of photographic light-sensitive materials is brought in contact with other objects, and for the purpose of making slippery (lubricious) the surface of photographic light-sensitive materials. Specifically some of such polymers are called matting agents.

Monodisperse matting agents for photography are described in JP-A ("JP-A" means unexamined published Japanese patent application) No. 230141/1986 and EP (European Patent) Nos. 610,522 and 618,490.

However, in photographic light-sensitive materials made by coating by using the above monodisperse particles, such problems often arise as that mat pinholes occur and the graininess of images is deteriorated.

On the other hand, monodisperse particulate polymers other than the above are reported on pages 265 to 270 in Polymer International 30 ('93). However, there is no example wherein these particulate polymers are used as photographic polymers.

SUMMARY OF THE INVENTION

Therefore, a first object of the present invention is to provide a particulate photographic polymer that is excellent in dispersion stability in coating solutions and that is prevented from settling and agglomerating in coating solutions.

A second object of the present invention is to provide a particulate photographic polymer that prevents the formation of mat pinholes improving graininess (granularity) of images.

Other and further objects, features, and advantages of the invention will appear more fully from the following description.

DETAILED DESCRIPTION OF THE INVENTION

The objects of the present invention have been attained by the following means:

That is, the present invention provides:

(1) A particulate photographic polymer, at least comprising a repeating unit represented by the following formula (I):

Formula (I)

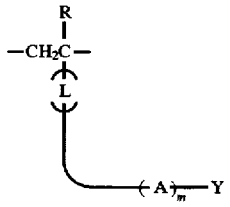

wherein R represents an alkyl group having 1 to 6 carbon atoms, a phenyl group, or a hydrogen atom; L represents a divalent organic binding group; A represents a repeating unit derived from at least one ethylenically unsaturated monomer, with $-(A)_m-$ being soluble in water or a hydrophilic organic liquid, or a repeating unit derived by ring opening polymerization of a nitrogen-containing heterocyclic compound, with $-(A)_m-$ being soluble in water or a hydrophilic organic liquid; m represents the number-average degree of polymerization of 2 or more but 200 or less; and Y represents a monovalent binding group;

(2) A particulate photographic polymer, comprising a polymer represented by the following formula (II):

Formula (II)

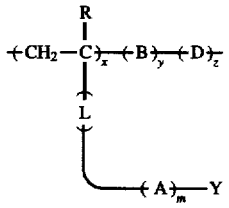

wherein R represents an alkyl group having 1 to 6 carbon atoms, a phenyl group, or a hydrogen atom; L represents a divalent organic binding group; A represents a repeating unit derived from at least one ethylenically unsaturated monomer, with $-(A)_m-$ being soluble in water or a hydrophilic organic liquid, or a repeating unit derived by ring opening polymerization of a nitrogen-containing heterocyclic compound, with $-(A)_m-$ being soluble in water or a hydrophilic organic liquid; m represents the number-average degree of polymerization of 2 or more but 200 or less; Y represents a monovalent binding group; B represents a repeating unit derived from at least one ethylenically unsaturated monomer that is soluble in a hydrophilic organic liquid and whose homopolymer is insoluble in said hydrophilic organic liquid; D represents a repeating unit derived from an ethylenically unsaturated monomer other than the last mentioned ethylenically unsaturated monomer; and x, y, and z represent composition proportions by weight of the respective monomer components, with x being 0.1 to 20% by weight, y being 40 to 99.9% by weight, and z being 0 to 50% by weight;

(3) The particulate photographic polymer as stated in the above (1) or (2), which is obtained by polymerizing, in a hydrophilic organic liquid, at least one compound represented by the following formula (III):

Formula (III)

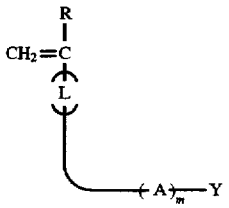

wherein R, L, A, m, and Y each have the same meanings as those of R, L, A, m, and Y in formula (I) or (II), and at least one ethylenically unsaturated monomer that is soluble in said hydrophilic organic liquid and whose polymer is insoluble in said hydrophilic organic liquid;

(4) The particulate photographic polymer as stated in the above (1), (2), or (3), wherein in formula (I), (II), or (III). A is at least one selected from (i) a repeating unit derived from N-substituted acrylamides, (ii) a repeating unit derived from N-vinylamides, and (iii) a repeating unit derived by ring open polymerization of 2-alkyl-2-oxazolines;

(5) The particulate photographic polymer as stated in the above (1), (2), (3), or (4), which comprises polymer particulates having an average particulate diameter of 0.5 to 20 μm; and (6) The particulate photographic polymer as stated in the above (1), (2), (3), (4), or (5), which comprises polymer particulates having a particulate diameter distribution whose deviation coefficient is 0.25 or less.

The particulate polymer having a repeating unit of formula (I) (hereinafter referred to as the polymer (I)) is a polymer comprising a macromonomer, and the particulate diameter distribution is monodisperse. The polymer (I) is in the form of polymer particulates that are insoluble in water and an aqueous alkali solution.

Herein, the term "insoluble" means that the polymer particulates are insoluble in an amount of 10% by weight or more in distilled water or an aqueous sodium hydroxide solution having a concentration of 1 mol/liter.

The ethylenically unsaturated monomer represented by formula (III) that constitutes the polymer (I) in the present invention (hereinafter referred to as the macromonomer (III)) is described below.

In formula (III), R represents a hydrogen atom, an alkyl group having 1 to 6 carbon atoms, or a phenyl group, and examples of the alkyl group include, for example, a methyl group, an ethyl group, and an oxycarbonylmethyl group. Preferably R represents a hydrogen atom or a methyl group.

The monomer that will constitute the repeating unit represented by A is an ethylenically unsaturated monomer or a nitrogen-containing heterocyclic compound. The homopolymer of the said monomer is soluble in water or a hydrophilic organic liquid, and herein the term "soluble" means that the polymer is soluble in an amount of 10% by weight or more in distilled water or a hydrophilic organic liquid.

Examples of the ethylenically unsaturated monomer that will constitute the repeating unit represented by A include, but are not limited to, N-vinylformamide, such as N-vinylpyrrolidone and N-vinylformamide; acrylic acid and methacrylic acid derivatives, such as acrylic acid, methacrylic acid, β-hydroxyethyl acrylate, and β-hydroxyethyl methacrylate; acrylamides, such as acrylamide, methacrylamide, acryloylmorpholine, acryloylpyrrolidine, and N,N-dimethylacrylamide; maleic acids; vinyl alcohol derivatives (e.g. vinyl acetate); and vinyl ethers, with preference given to N-vinylamides and acrylamides, and particular preference given to acrylamides.

Examples of the nitrogen-containing heterocyclic compound capable of ring opening polymerization that will constitute the repeating unit represented by A include, but are not limited to, oxazolines, such as 2-methyl-2-oxazoline and 2-ethyl-2-oxazoline; oxazines, such as 2-methyloxazine and 2-ethyloxazine; dicyclic amidoacetals, such as 5-methyl-4,6-dioxa-1-azabicyclooctane[3.3.0]; and 3-membered cyclic imines, such as ethyleneimine, 2-methylethyleneimine, and N-acetylethyleneimine, with preference given to oxazolines and dicyclic amidoacetals, and particular preference given to oxazolines represented by the following formula (IV):

Formula (IV)

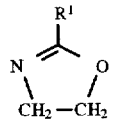

wherein $R^1$ represents a hydrogen atom, or an alkyl group, an alkenyl group, or an alkynyl group, each having 1 to 4 carbon atoms, each of which may be interrupted by —COO— or —CONH— in the middle and may be a straight chain or a branched chain.

As the above nitrogen-containing compound, the following specific example can be mentioned:

(Monomer 1)

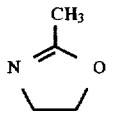

(Monomer 2)

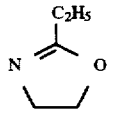

(Monomer 3)

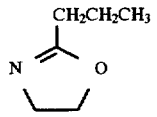

(Monomer 4)

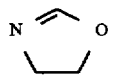

(Monomer 5)

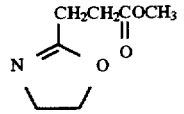

(Monomer 6)

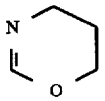

(Monomer 7)

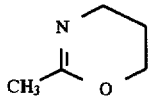

(Monomer 8)

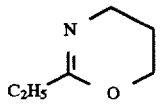

(Monomer 9)

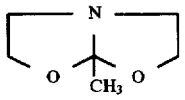

(Monomer 10)

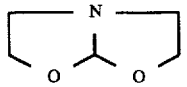

(Monomer 11)

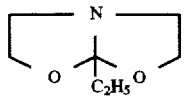

(Monomer 12)

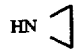

-continued

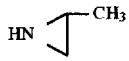

(Monomer 13)

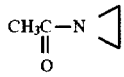

(Monomer 14)

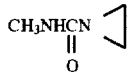

(Monomer 15)

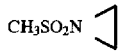

(Monomer 16)

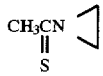

(Monomer 17)

The monomer that will form the repeating unit represented by A may be a combination of two or more of the above-described monomers. The particular monomer may be one formed by copolymerization of the said particular monomer with a monomer whose homopolymer is insoluble in water or a hydrophilic organic liquid (a so-called hydrophobic monomer). In this case, the ratio of the components is determined in such a range that the obtained copolymer is soluble in water and a hydrophilic organic liquid.

The structure of the divalent organic binding group represented by L is suitably selected according to the manner of the polymerization of the repeating unit represented by A. Examples of the divalent organic binding group, when $-(A)_m-$ is synthesized by the radical polymerization method, are given below but are not to be construed as limiting the present invention:

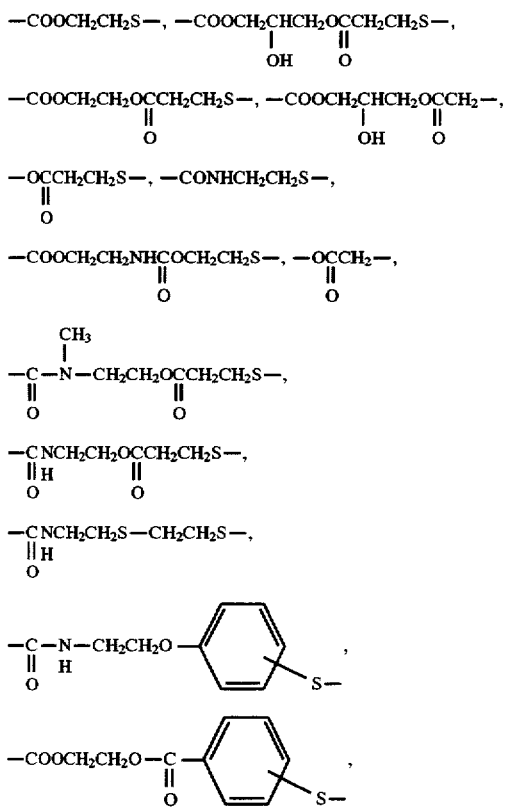

-continued

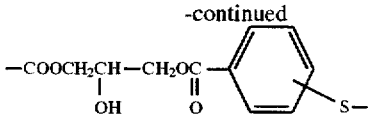

Further, Examples of the divalent organic binding group, when $-(A)_m-$ is synthesized by the ring opening polymerization, are given below but are not to be construed as limiting the present invention:

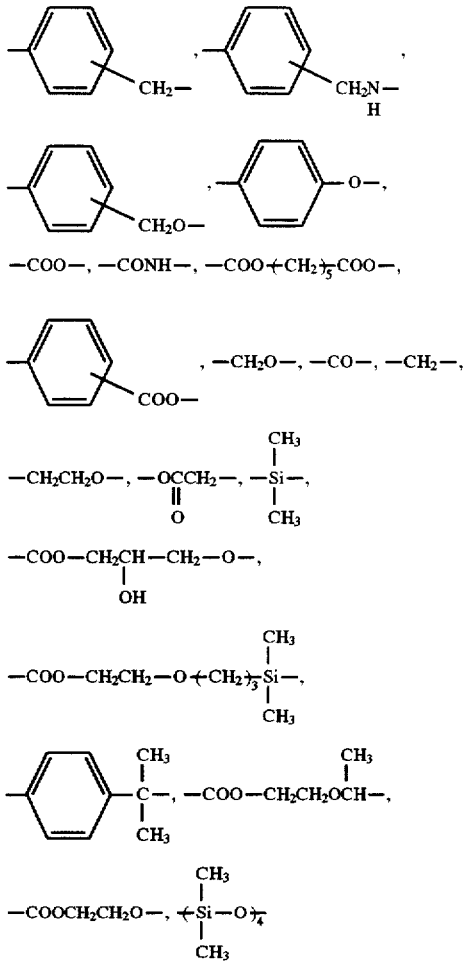

Preferable examples of the structure of the divalent organic binding group represented by L are as follows:

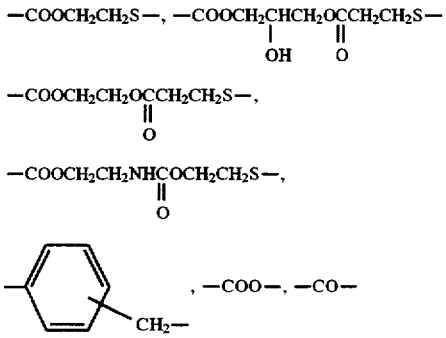

m represents the number-average degree of polymerization and is a number of from 2 to 200, and m is preferably a number of from 5 to 150, more preferably a number of from 10 to 120.

Y represents a monovalent binding group, which is usually introduced by the initiation reaction or the termination reaction of polymerization. Examples of the monovalent binding group represented by Y include, for example, a hydrogen atom, a halogen atom (e.g. a chlorine atom and an iodine atom), and a hydroxyl group, with preference given to a hydrogen atom and a hydroxyl group.

The macromonomer can be synthesized according to methods described in British Patent No. 1096912 or polym. Bull (Berlin), 13 (1985), page 140.

Examples of the macromonomer (III) are listed below but are not to be construed as limiting the present invention.

(Macromonomer 1)

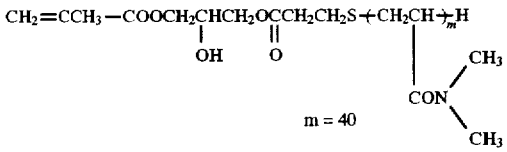

(Macromonomer 2)

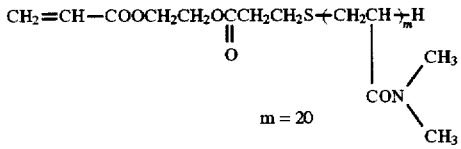

(Macromonomer 3)

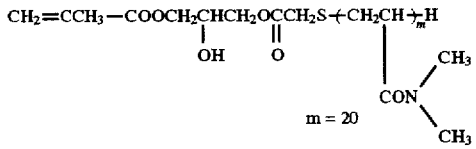

(Macromonomer 4)

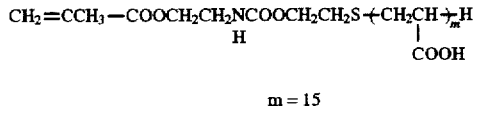

(Macromonomer 5)

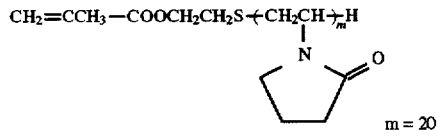

(Macromonomer 6)

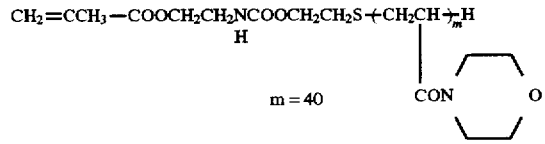

(Macromonomer 7)

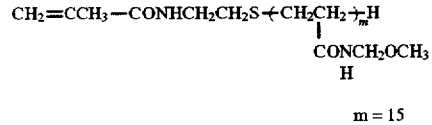

-continued
(Macromonomer 8)
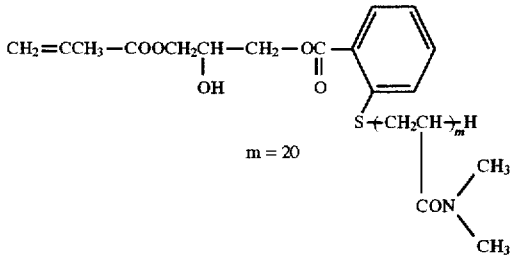
m = 20
(Macromonomer 9)
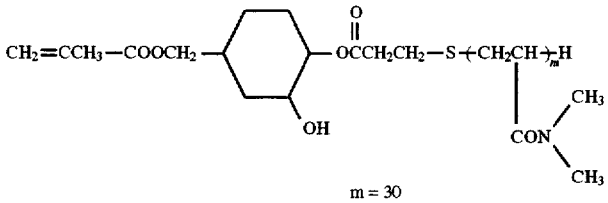
m = 30
(Macromonomer 10)
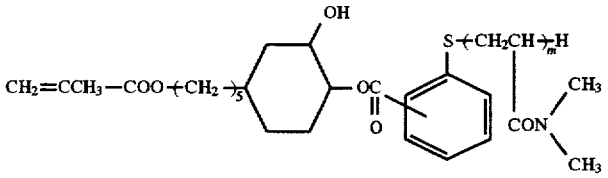
m = 50
(Macromonomer 11)
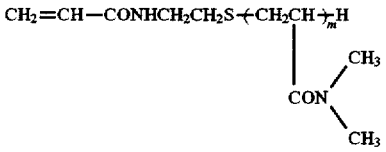
m = 80
(Macromonomer 12)
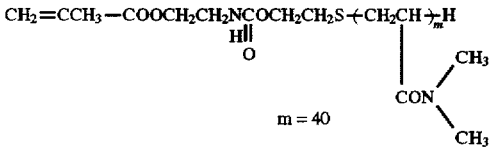
m = 40
(Macromonomer 13)
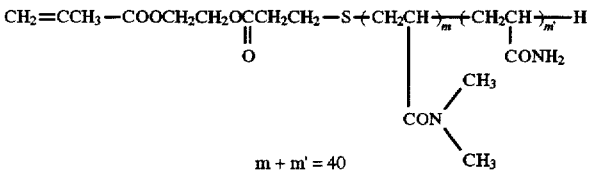
m + m' = 40
m/m' = 50/50 (weight ratio)

-continued
(Macromonomer 14)
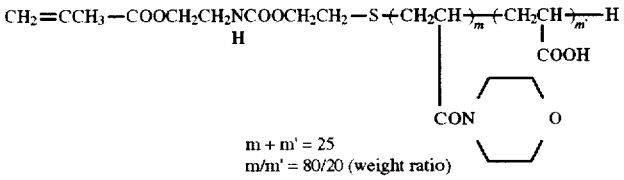
m + m' = 25
m/m' = 80/20 (weight ratio)
(Macromonomer 15)
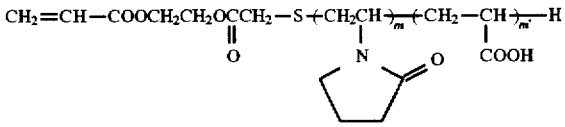
m + m' = 38
m/m' = 80/20 (weight ratio)
(Macromonomer 16)
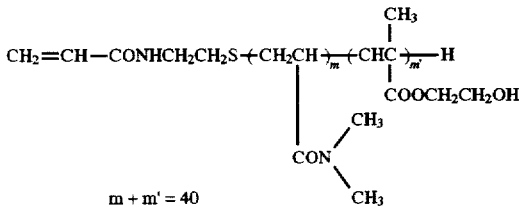
m + m' = 40
m/m' = 90/10 (weight ratio)
(Macromonomer 17)
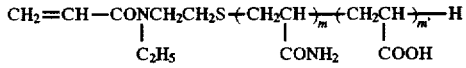
m + m' = 90
m/m' = 90/10 (weight ratio)
(Macromonomer 18)
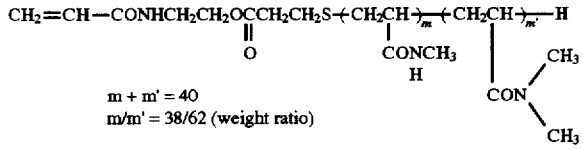
m + m' = 40
m/m' = 38/62 (weight ratio)
(Macromonomer 19)
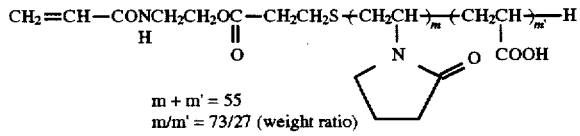
m + m' = 55
m/m' = 73/27 (weight ratio)
m = 40
m' = 15
(Macromonomer 20)
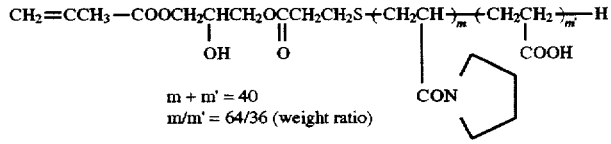
m + m' = 40
m/m' = 64/36 (weight ratio)

-continued
(Macromonomer 21)
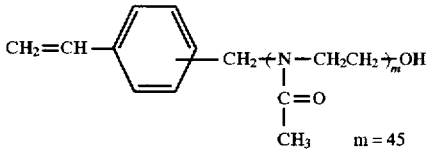
(Macromonomer 22)
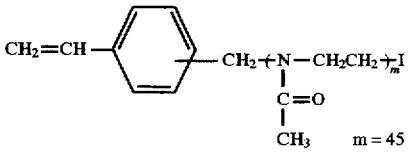
(Macromonomer 23)
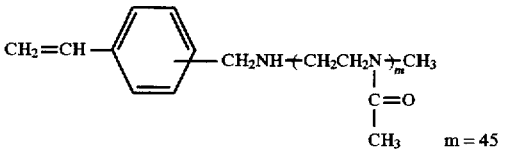
(Macromonomer 24)
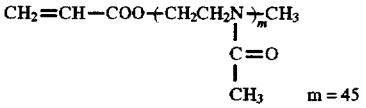
(Macromonomer 25)
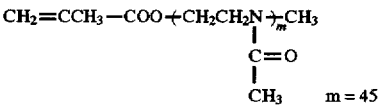
(Macromonomer 26)
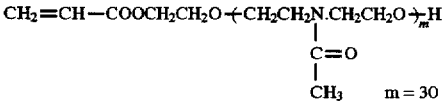
(Macromonomer 27)
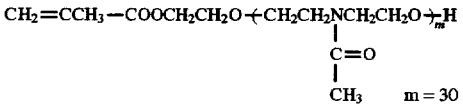
(Macromonomer 28)
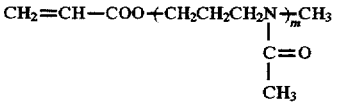
(Macromonomer 29)
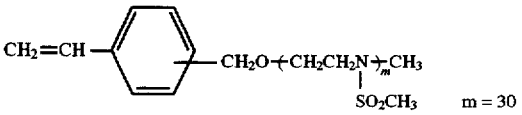

-continued (Macromonomer 30)

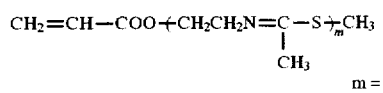

m = 50

Preferable examples of the macromonomer (III) are the above macromonomer 1, the macromonomer 2, the macromonomer 12, the macromonomer 21, the macromonomer 22, the macromonomer 24, and the macromonomer 25.

Preferably, the polymer of the present invention having a repeating unit represented by formula (I) is a polymer represented by formula (II). Such the polymer is one comprising a repeating unit of the formula (I) and at least one repeating unit derived from an ethylenically unsaturated monomer that is soluble in a hydrophilic organic liquid and whose polymer (homopolymer of the monomer) is insoluble in said hydrophilic organic liquid.

The number average molecular weight of the photographic polymers having a repeating unit represented by formula (I) or (II) of the present invention is generally in the range of 10,000 to 1,000,000.

Now, the B and D constituents of the particulate polymer represented by formula (II) in the present invention are described.

B represents a repeating unit derived from at least one ethylenically unsaturated monomer that is soluble in a hydrophilic organic liquid and whose polymer (a homopolymer from the monomer) is insoluble in the said hydrophilic organic liquid.

Herein, the term "insoluble" means that the polymer is insoluble in an amount of 10% by weight or more to the hydrophilic organic liquid.

Typical examples of the ethylenically unsaturated monomer from which the repeating unit B is derived are enumerated, but they are not to be construed as limiting the present invention:

Acrylates, such as methyl acrylate, cyclohexyl acrylate, benzyl acrylate, and phenyl acrylate; mathacrylates, such as methyl methacrylate, ethyl methacrylate, n-butyl methacrylate, isobutyl methacrylate, t-butyl methacrylate, cyclohexyl methacrylate, phenyl methacrylate, and benzyl methacrylate; styrenes, such as styrene, o-methylstyrene, m-methylstyrene, p-methylstyrene, α-methylstyrene, p-tert-butylstyrene, and p-chlorostyrene; and vinyl halides, such as vinylidene chloride, all of the preceding of which may be used singly or as a combination of two or more.

In order to provide the polymer constituting the obtained particulates with characteristics in the capacity of a matting agent, the glass transition temperature of that polymer is preferably at room temperature or higher, and the higher the glass transition temperature is, the more preferable it is. A preferable range of the glass transition temperature is 60° C. or higher, and more preferably 80° C. or higher.

Therefore, preferable among ethylenically unsaturated monomers are methyl mathacrylate, styrene, and p-chlorostyrene, and a combination thereof with another monomer, with particular preference given to methyl methacrylate and a combination of methyl methacrylate with another monomer.

The ethylenically unsaturated monomer that gives the repeating unit represented by D may be any ethylenically unsaturated monomer. It is desirable to introduce the repeating unit of D to make the particulates hydrophilic, for example.

Examples are enumerated below but are not to be construed as limiting the present invention:

Acrylic acids and methacrylic acids, such as acrylic acid, methacrylic acid, hydroxyethyl methacrylate, and hydroxyethyl acrylate; dicarboxylic acids containing a vinyl group, such as itaconic acid; styrenes, such as styrenecarboxylic acid, aminomethylstyrene, and styrenesulofonic acid; acrylamides, such as AMPS (2-acrylamido-2-methylpropanesulfonic acid), acrylamide, N,N-dimethyl acrylamide, and acryloylmorpholine; and N-vinylamides, such as N-vinylpyrrolidone.

Among these, methacrylic acids and acrylic acids are particularly desirable.

As the ethylenically unsaturated monomer that gives the repeating unit represented by D, a monomer having at least two ethylenically unsaturated groups may be chosen.

Examples of the monomer having at least two ethylenically unsaturated groups are 4'-isopropylidenediphenylene diacrylate, divinylbenzene, 1,3-butylene diacrylate, 1,3-butylene dimethacrylate, 1,4-cyclohexylenedimethylene dimethacrylate, diethylene glycol dimethacrylate, diisopropylidene glycol dimethacrylate, divinyloxymethane, ethylene glycol diacrylate, ethylene glycol dimethacrylate, ethylidene diacrylate, ethylidene dimethacrylate, 1,6-diacrylamidohexane, N,N'-methylenebisacrylamide, N,N'-(1,2-dihydroxy)ethylenebisacrylamide, 2,2-dimethyl-1,3-trimethylene dimethacrylate, phenylethylene dimethacrylate, tetraethylene glycol dimethacrylate, tetramethylene diacrylate, tetramethylene dimethacrylate, 2,2,2-trichloroethylidene dimethacrylate, triethylene glycol diacrylate, pentaerythritol triacrylate, trimethylolpropane triacrylate, tetramethylolmethane tetraacrylate, triethylene glycol dimethacrylate, 1,3,5-triacryloylhexanehydro s-triazine, bisacrylamido-acetic acid, ethylidyne trimethacrylate, propylidyne triacrylate, and vinylallyoxyacetate, which are not to be construed as limiting the present invention. Further, these monomers can be used in combination.

Particularly preferable among these are ethylene glycol dimethacrylate, divinylbenzene, N,N'-methylenebisacrylamide, diethylene glycol dimethacrylate, triethylene glycol dimethacrylate, tetraethylene glycol dimethacrylate, and trimethylolpropane trimethacrylate.

Further, those monomers can be used in combination with each other and in combination with another monomer.

Preferable combinations of B and D include a combination of methyl methacrylate and methacrylic acid, a combination of methyl methacrylate, methacrylic acid, and divinylbenzene, and a combination of methyl methacrylate, methacrylic acid, and ethylene glycol dimethacrylate.

Next, x, y, and z are described. x, y, and z represent composition proportions by weight of the respective monomer components, with x being 0.1 to 20% by weight, y being 40 to 99.9% by weight, and z being 0 to 50% by weight.

Preferably x is 0.1 to 15% by weight, and particularly preferably 0.2 to 10% by weight.

Preferably y is 50 to 99% by weight, and particularly preferably 60 to 99% by weight.

Preferably z is 1 to 40% by weight, and particularly preferably 5 to 30% by weight.

Preferably the average particulate diameter of the compound (I) of the present invention is 0.5 to 20 μm, more preferably 1 to 10 μm, and particularly preferably 1 μm or more but less than 3 μm. The particulates of the polymer (compound) (I) of the present invention are particles which preferably have the above size of particle.

Preferably the particulate diameter (particle diameter) dispersion of the particulates of the compound (I) of the present invention has a deviation coefficient of 0.25 or less, and particularly preferably 0.10 or less.

The deviation coefficient in the present invention is defined by the following formula (1):

$$\sqrt{\frac{\Sigma(\bar{r}-r_i)^2\cdot n_i}{\Sigma n_i}}\div\bar{r} \qquad \text{formula (1)}$$

wherein $\bar{r}$ represents the number-average particulate diameter, $n_i$ represents the ith particulate, and $r_i$ represents the particulate diameter of the ith particulate.

As the evaluation method of the particulate diameter, the following method was adopted.

The particulate dispersion was cast on a copper thin film and was dried, and the Au-coated sample was magnified 1,500 times under a scanning-type electron microscope (JSM-5400, manufactured by JEOL Ltd.) and was photographed. Correction of the magnification was carried out by simultaneously photographing a diffraction grating (500 lines/mm). Using the obtained photograph, the diameters of the cross section of 200 or more particulates per sample were measured with a Particle Size Analyzer TGZ-3 (Carl Zeiss Co.), to find the number-average particulate diameter (particle diameter), and after the standard deviation was calculated, the deviation coefficient was calculated in accordance with the above formula (1).

The particulate polymer of the present invention can be synthesized by dispersion polymerization.

Methods of controlling the particle diameter and the particle diameter distribution of the polymer particulates produced in the dispersion polymerization are disclosed, for example, in Brit. Polyme. J., 14,131 (1982); J. Polym. Sci.: Part A, 24, 2995–3007 (1986); ibid., 31, 1393–1402 (1993); JP-B ("JP-B" means examined Japanese patent publication) Nos. 59924/1993 and 17373/1994; JP-A Nos. 23805/1992, 43604/1993, and 43605/1993; Collection of Reports of Polymers (Kobunshi Ronbun-shu), 50, No. 4, 243–250, 251–257 (1993); and Colloid Polym Sci., 267:193–200 (1989).

The dispersion polymerization method in the present invention, for example, for the polymer represented by formula (II), involves such constitutional factors as a hydrophilic organic liquid, an ethylenically unsaturated monomer, a macromonomer (III), and an initiator.

First, examples of the hydrophilic organic liquid include alcohols having 4 carbon atoms or less (e.g. methanol, ethanol, 1-propanol, 2-propanol, 2-methoxy-1-propanol, butanol, and t-butanol), ketones having 4 carbon atoms or less (e.g. acetone and 2-butanone), carboxylic acid esters having 5 carbon atoms or less (e.g. methyl acetate and ethyl acetate), and carboxylic acid amides having 4 carbon atoms or less (e.g. N,N-dimethylformamide and N,N-dimethylacetamide), with preference given to alcohols having 4 carbon atoms or less, and particular preference given to methanol and ethanol. Further, a mixed system of the above liquid and water is preferable as a polymerization medium.

The present invention is characterized in that the macromonomer (III) is combined directly to form particulates stably.

As the polymerization initiator for the ethylenically unsaturated monomer, for example, azo initiators, such as 2,2'-azobisisobutylonitrile, 2,2'-azobis(2,4-dimethylvaleronitrile), and dimethyl 2,2'-azobis(2-methylpropionate); and peroxide initiators, such as lauryl peroxide, benzoyl peroxide, and tert-bubyl peroctoate, can be used.

In the dispersion polymerization in the present invention, a chain transfer agent may be used. Examples of preferable compounds in the case of use of a chain transfer agent include halogenated hydrocarbons, such as carbon tetrachloride, carbon tetrabromide, ethyl dibromoactatate, ethyl tribromoacetate, dibromoethylbenzene, dibromoethane, and dichloroethane; diazothioethers; hydrocarbons, such as benzene, ethylbenzene, and isopropylbenzene; mercaptans, such as mercaptans having an SH group at the end of an alkyl group or at the end of an alkyl group modified with various functional groups, e.g. tert-dodecyl mercaptan, n-dodecyl mercaptan, hexadecyl mercaptan (cetyl mercaptan), n-octadecyl mercaptan (stearyl mercaptan), and thioglycerol; disulfides, such as diisopropylxanthogene disufide; and thioglycollic acid derivatives, such as thioglycollic acid, 2-ethylhexyl thioglycolate, butyl thioglycolate, methoxybutyl thioglycolate, and trimethylolpropane tris(thioglycolate). The usage of a chain transfer agent, when used, is desirably 3% by weight or less to the ethylenically unsaturated monomer.

Specific examples of the particulate polymer compound (II) of the present invention are shown in Table 1 below. The compositions are shown in terms of percent by weight.

The polymer compositions, the particle diameters, and the deviation coefficients are shown in Table 1 below. In Table 1, MMA represents methyl methacrylate, MA represents methacrylic acid, AA represents acrylic acid, and ST represents styrene. After the figures, percent by weight is omitted.

TABLE 1

| Polymer No. | Macro-monomer No. | Monomer composition MMA | MA | Other | Number-average particle diameter | Deviation coefficient |
|---|---|---|---|---|---|---|
| P-1 | M-1 (1) | 89 | 10 | — | 2.3 μm | 0.115 |
| P-2 | M-2 (1) | 89 | 10 | — | 2.5 μm | 0.161 |
| P-3 | M-3 (1) | 89 | 10 | — | 2.2 μm | 0.175 |
| P-4 | M-4 (1) | 70 | 10 | DVB (19) | 2.2 μm | 0.200 |
| P-5 | M-5 (1) | — | 10 | ST (89) | 2.3 μm | 0.091 |
| P-6 | M-6 (1) | 95 | — | AA (4) | 2.1 μm | 0.198 |
| P-7 | M-7 (0.3) | — | — | P-Cl-ST (99.7) | 3.7 μm | 0.115 |
| P-8 | M-8 (0.9) | 89.1 | 10 | — | 2.3 μm | 0.051 |
| P-9 | M-9 (1) | 89 | 10 | — | 4.0 μm | 0.155 |
| P-10 | M-10 (1) | 89 | 10 | — | 8.0 μm | 0.200 |
| P-11 | M-11 (1) | 89 | 10 | — | 3.2 μm | 0.199 |
| P-12 | M-12 (1) | 89 | 10 | — | 2.3 μm | 0.110 |
| P-13 | M-13 (1) | 89 | 10 | — | 2.5 μm | 0.175 |
| P-14 | M-14 (1) | 89 | 10 | — | 2.7 μm | 0.125 |
| P-15 | M-15 (1) | 99 | — | — | 3.1 μm | 0.115 |
| P-16 | M-16 (1) | 89 | 10 | — | 3.0 μm | 0.095 |
| P-17 | M-17 (1) | 99 | — | — | 2.7 μm | 0.092 |
| P-18 | M-18 (1) | 89 | 10 | — | 1.9 μm | 0.183 |
| P-19 | M-19 (1) | 89 | 10 | — | 2.2 μm | 0.089 |
| P-20 | M-20 (1) | 89 | 10 | — | 2.5 μm | 0.155 |
| P-21 | M-21 (1) | 89 | 10 | — | 2.3 μm | 0.075 |
| P-22 | M-22 (1) | 89 | 10 | — | 2.2 μm | 0.084 |
| P-23 | M-23 (1) | 89 | 10 | — | 2.5 μm | 0.145 |
| P-24 | M-24 (1) | 89 | 10 | — | 2.1 μm | 0.039 |
| P-25 | M-25 (1) | 89 | 10 | — | 2.5 μm | 0.116 |
| P-26 | M-26 (1) | 89 | 10 | — | 2.4 μm | 0.182 |
| P-27 | M-27 (1) | 89 | 10 | — | 2.3 μm | 0.193 |
| P-28 | M-28 (1) | 89 | — | DVB (10) | 2.7 μm | 0.135 |

TABLE 1-continued

| Polymer No. | Macro-monomer No. | Monomer composition MMA | MA | Other | Number-average particle diameter | Deviation co-efficient |
|---|---|---|---|---|---|---|
| P-29 | M-29 (1) | ST (89) | | AA (10) | 7.5 μm | 0.072 |
| P-30 | M-30 (1) | ST (89) | | DVB (10) | 9.8 μm | 0.034 |
| P-31 | M-22 (0.2) | 99.8 | — | — | 2.4 μm | 0.100 |

DVB represents divinylbenzene
ST represents styrene
P-Cl-ST represents p-chlorostyrene Next, synthetic examples of the macromonomer (III) are described but are not to be construed as limiting the present invention.

Synthetic Example 1

Synthesis of Macromonomer 1

350 ml of N,N-dimethylformamide was placed in a 1-liter, three-necked flask equipped with a stirrer and a reflux condenser, and it was heated in an oil bath under a flow of nitrogen. After the temperature in the flask reached 70° C. and was stabilized, 350 g of N,N-dimethyl-acrylamide, 8 g of 3-mercaptopropionic acid, and 3.5 g of 4,4'-azobis-4-cyanovarelic acid were added. The temperature in the flask was elevated to 80° C., followed by stirring for 3 hours. After the completion of the polymerization, a small amount of the obtained mixture was taken as a sample, and the terminal COOHs were measured by neutralization titration, to find the number-average molecular weight Mn, which was 3,500. Then, a solution of a mixture of 42.6 g of glycidyl methacrylate, 2 ml of dimethyldecylamine, and 2 g of 4-methoxyphenol was added into the flask, followed by stirring at 140° C. for 6 hours. After cooling, 2.5 liters of ethyl acetate was added for dilution; then the reaction liquid was added to 2.5 liters of hexane, and the precipitate was filtered, collected, and dried in vacuo, to obtain 290 g of a poly(N,N-dimethylacrylamide) macromonomer.

Synthetic Example 2

Synthesis of Macromonomer 2

350 ml of toluene was placed in a 1-liter, three-necked flask equipped with a stirrer and a reflux condenser, and it was heated in an oil bath under a flow of nitrogen. After the temperature in the flask reached 70° C. and was stabilized, 350 g of N,N-dimethylacrylamide, 16 g of 3-mercaptopropionic acid, and 3.5 g of 4,4'-azobis-4-cyanovarelic acid were added. The temperature in the flask was elevated to 80° C., followed by stirring for 3 hours. After the completion of the polymerization, a small amount of the obtained mixture was taken as a sample, and the terminal COOHs were measured by neutralization titration, to find the number-average molecular weight Mn, which was 1,850. Then, a solution of a mixture of 45.5 g of 2-hydroxyethyl acrylate, 90 g of dicyclohexylcarbodiimide, 1.8 g of 4-dimethylaminopyridine, and 2 g of 4-methoxyphenol was added into the flask, followed by stirring for 6 hours at room temperature. Then 60 ml of formic acid was added, followed by stirring for 2 hours. The reaction liquid was added to 2.5 liters of hexane, and the precipitate was filtered, collected, and dried in vacuo, to obtain 350 g of a poly(N,N-dimethylacrylamide) macromonomer.

Synthetic Example 3

Synthesis of Macromonomer 6

350 ml of N,N-dimethylformamide was placed in a 1-liter, three-necked flask equipped with a stirrer and a reflux condenser, and it was heated in an oil bath under a flow of nitrogen. After the temperature in the flask reached 70° C. and was stabilized, 350 g of acryloylmorpholine, 4.9 g of 3-mercaptopropionic acid, and 3.5 g of 4,4'-azobis-4-cyanovarelic acid were added. The temperature in the flask was elevated to 110° C., followed by stirring for 3 hours. After the completion of the polymerization, a small amount of the obtained mixture was taken as a sample, and the terminal COOHs were measured by neutralization titration, to find the number-average molecular weight Mn, which was 6,200. Then a solution of a mixture of 46.5 g of methacryloyloxyethyl isocyanate, 0.5 g of dibutyltin dilaurate, and 2 g of 4-methoxyphenol was added to the flask, followed by stirring at 90° C. for 2 hours. After cooling, the reaction liquid was added to 2.5 liters of ethyl acetate, and the precipitate was filtered, collected, and dried in vacuo, to obtain 230 g of a poly(acryloylmorpholine) macromonomer.

Other vinyl macromonomers were synthesized in the similar manner.

Synthetic Example 4

Synthesis of Macromonomer 22

100 ml of N,N-dimethylformamide was placed in a 500-ml, three-necked flask equipped with a stirrer and a reflux condenser, and it was heated in an oil bath under a flow of nitrogen. After the temperature in the flask reached 90° C. and was stabilized, 66 g of 2-methyl-2-oxazoline and 4.4 g of iodomethylstyrene were added, followed by stirring for 3.5 hours. After cooling, the reaction liquid was added to 1.5 liters of ethyl acetate, the precipitate was filtered, collected, and dried in vacuo, to obtain 65 g of a poly(2-methyl-2-oxazoline) macromonomer. It was subjected to GPC, to find that the number-average molecular weight Mn was 3,900, and the molecular weight distribution (Mw/Mn) was 1.7.

Other ring opening polymerization-type macromonomers were synthesized in the similar manner.

The results of the above and other synthesized macromonomers are summarized in Table 2.

TABLE 2

| Sample | Number-average molecular weight | Yield |
|---|---|---|
| Macromonomer 1 | 3500 | 80 |
| Macromonomer 2 | 1850 | 94 |
| Macromonomer 3 | 2100 | 89 |
| Macromonomer 4 | 1500 | 62 |
| Macromonomer 5 | 2520 | 75 |
| Macromonomer 6 | 6200 | 60 |
| Macromonomer 7 | 1920 | 70 |
| Macromonomer 8 | 2340 | 91 |
| Macromonomer 21 | 3900 | 90 |
| Macromonomer 22 | 3900 | 93 |

Now, synthetic examples of the polymer (I) are described but are not to be construed as limiting the present invention.

Synthetic Example 5

Synthesis of Polymer 1 (Particulate Synthesis)

180 g of ethanol and 270 g of water were placed in a 1-liter, three-necked flask equipped with a stirrer and a reflux condenser, and they were heated in an oil bath under a flow of nitrogen. After the temperature in the flask reached 70° C. and was stabilized, 0.5 g of Macromonomer 1 (Synthetic Example 1), 44.5 g of methyl methacrylate, 5 g of methacrylic acid, and 1.0 g of 2,2'-azobis(2-methylpropionate) were added, followed by stirring for 6 hours. After cooling, the reaction liquid was filtered, to obtain a particulate dispersion of milky Polymer 1 (solid content: 10.5% by weight). It was subjected to GPC, to find that the number-average molecular weight Mn was 29,800, and the molecular weight distribution (Mw/Mn) was 4.0; it was also found that the particle diameter (particulate diameter) was 2.3 μm, the deviation coefficient was 0.115, and the solid yield was 98%.

Synthetic Example 6

Synthesis of Polymer 2 (Particulate Synthesis)

180 g of ethanol and 270 g of water were placed in a 1-liter, three-necked flask equipped with a stirrer and a reflux condenser, and they were heated in an oil bath under a flow of nitrogen. After the temperature in the flask reached 65° C. and was stabilized, 0.5 g of Macromonomer 2 (Synthetic Example 2), 44.5 g of methyl methacrylate, 5 g of methacrylic acid, and 1.0 g of 2,2'-azobis(2-methylpropionate) were added, followed by stirring for 6 hours. After cooling, the reaction liquid was filtered, to obtain a particulate dispersion of milky Polymer 2 (solid content: 10.4% by weight). It was subjected to GPC, to find that the number-average molecular weight Mn was 36,500, and the molecular weight distribution (Mw/Mn) was 3.9; it was also found that the particle diameter was 2.5 μm, the deviation coefficient was 0.161, and the solid yield was 97%.

Synthetic Example 7

Synthesis of Polymer 6 (Particulate Synthesis)

180 g of ethanol and 270 g of water were placed in a 1-liter, three-necked flask equipped with a stirrer and a reflux condenser, and they were heated in an oil bath under a flow of nitrogen. After the temperature in the flask reached 70° C. and was stabilized, 0.5 g of Macromonomer 6 (Synthetic Example 3), 47.5 g of methyl methacrylate, 2 g of acrylic acid, and 1.0 g of 2,2'-azobis(2-methylpropionate) were added, followed by stirring for 6 hours. After cooling, the reaction liquid was filtered, to obtain a particulate dispersion of milky Polymer 6 (solid content: 10.2% by weight). It was subjected to GPC, to find the number-average molecular weight Mn, which was 32,000, and the molecular weight distribution (Mw/Mn) was 3.5; it was also found that the particle diameter was 2.1 μm, the deviation coefficient was 0.198, and the solid yield was 95%.

Synthetic Example 8

Synthesis of Polymer 22 (Particulate Synthesis)

180 g of ethanol and 270 g of water were placed in a 1-liter, three-necked flask equipped with a stirrer and a reflux condenser, and they were heated in an oil bath under a flow of nitrogen. After the temperature in the flask reached 70° C. and was stabilized, 0.5 g of Macromonomer 22 (Synthetic Example 4), 44.5 g of methyl methacrylate, 5 g of methacrylic acid, and 1.0 g of 2,2'-azobis(2-methylpropionate) were added, followed by stirring for 6 hours. After cooling, the reaction liquid was filtered, to obtain a particulate dispersion of milky Polymer 22 (solid content: 10.8% by weight). It was subjected to GPC, to find the number-average molecular weight Mn, which was 32,500, and the molecular weight distribution (Mw/Mn) was 3.6; it was also found that the particle diameter was 2.2 μm, the deviation coefficient was 0.084, and the solid yield was 99%.

The results of the above and other synthesized particulates are summarized in Table 3.

TABLE 3

| Sample | Polymer | Number-average molecular weight | Molecular-weight distribution | Number-average particle diameter (μm) | Deviation coefficient |
|---|---|---|---|---|---|
| Particulate 1 (Synthetic Example 5) | Polymer-1 (P-1) | 29,800 | 4.0 | 2.3 | 0.115 |
| Particulate 2 (Synthetic Example 6) | Polymer-2 (P-2) | 36,500 | 3.9 | 2.5 | 0.161 |
| Particulate 3 (Synthetic Example 7) | Polymer-6 (P-6) | 32,000 | 3.5 | 2.1 | 0.198 |
| Particulate 4 (Synthetic Example 8) | Polymer-22 (P-22) | 32,500 | 3.6 | 2.2 | 0.084 |
| Particulate 5 | Polymer-4 (P-4) | — | — | 2.2 | 0.200 |
| Particulate 6 | Polymer-5 (P-5) | 38,200 | 3.1 | 2.3 | 0.091 |
| Particulate 7 | Polymer-8 (P-8) | 41,000 | 3.0 | 2.3 | 0.051 |

Further, the molecular weights were evaluated as follows: 0.1 g of the particulate dispersion was dissolved in 10 ml of tetrahydrofuran, and after the mixture was filtered, the filtrate was subjected to gel permeation chromatography (GPC), to find the number-average molecular weight (Mn) and the molecular weight distribution (Mw/Mn) in terms of polystyrenes using a calibration curve made previously using polystyrene standard samples.

The polystyrene standard samples that were used were the following: F-80 ($Mw=7.06\times10^5$, $Mw/Mn=1.05$), F-20 ($Mw=1.9\times10^5$, $Mw/Mn=1.04$), F-4 ($Mw=4.39\times10^4$, $Mw/Mn=1.01$), and A-5000 ($Mw=5.5\times10^3$, $Mw/Mn=1.03$), all of which were commercially available from Tosoh Corporation.

Preferably the amount of the particulates of polymer (I) of the present invention to be added to a layer, e.g. a photographic constitutional layer, is 0.1 to 200 mg/m$^2$, and more preferably 5 to 100 mg/m$^2$.

The layer that will contain the particulates of polymer (I) of the present invention may be a layer either on the side of the emulsion layers on the support, or on the side on the support opposite to the emulsion layers. Preferably the layer that will contain the particulates of polymer (I) of the present invention is a layer that is on the side of the emulsion layers on the support and that is more remote from the support than the emulsion layers, an outermost layer that is on the side on the support opposite to the emulsion layers, or a layer near the outermost layer.

In the present invention, "the layer near the outermost layer" is not limited to a layer adjacent to the outermost layer but includes layers situated in the range where the polymer particulates of the present invention can make the surface of the outermost layer matted.

In the present invention, it is preferable to provide at least one silver halide emulsion layer to constitute a silver halide photographic light-sensitive material. This silver halide emulsion layer can be coated on a support directly or through another layer, for example, through a hydrophilic colloid layer free from any silver halide emulsion. A hydrophilic colloid layer may be coated on the silver halide emulsion layer as a protective layer. The silver halide emulsion layer may be applied in the form of divided silver halide emulsion layers different in sensitivity, such as a high-sensitive silver halide emulsion layer and a low-sensitive silver halide emulsion layer. In that case, an intermediate layer may be provided between the silver halide emulsion layers. That is, as required, an intermediate layer comprising a hydrophilic colloid may be provided. Further, a non-light-sensitive hydrophilic colloid layer, such as an intermediate layer, a protective layer, an antihalation layer, and a backing layer, may be provided between the silver halide emulsion layer and the protective layer. A magnetic recording layer or the like may also be provided on the side opposite to the silver halide emulsion layer.

Preferably the thickness of the magnetic recording layer is 0.1 to 10 μm, and more preferably 0.5 to 3 μm. To the coating solution that will form the magnetic recording layer, may be added an additive, such as a lubricant and an antistatic agent, to provide the magnetic recording layer with functions, for example, for making it lubricative, for reducing static-electrical charges, for preventing adhesion, and for improving friction and wear properties. To the coating solution may be added, further, for example, a plasticizer for making the magnetic recording layer flexible, a dispersant for helping the magnetic material disperse in the coating solution, and an abrasive for preventing a magnetic head from being clogged.

In order to prevent fogging due to static electricity from occurring, it is preferable to add an antistatic agent, such as particles of a metal oxide.

In order to improve adhesion and wettability with the coating solution, if necessary, the support may previously be subjected such various surface treatments, such as a corona discharge treatment, a treatment with a chemical liquid, and a flame treatment. Among them, a glow discharge treatment is most preferably used. The polyester support for use in the present invention is preferably provided with an underlayer to increase the adhesion to photographic constitutional layers, such as light-sensitive layers, that will be applied on the support. As the underlayer, one that uses a hydrophilic binder, such as gelatin, can be mentioned. The preferable underlayer for use in the present invention is one that uses a hydrophilic binder. Examples of the hydrophilic binder that is used in the present invention include water-soluble polymers, cellulose esters, latex polymers, and water-soluble polyesters. Examples of the water-soluble polymer include, hydrophilic polymers, such as gelatin, gelatin derivatives, casein, agar-agar, sodium alginate, starch, polyvinyl alcohols, polyacrylic acid copolymers, maleic anhydride copolymers, polyester resins, vinyl polymers, vinyl copolymers, and polyurethane resins. Examples of a compound that can cause the polyester film for use in the present invention to swell, include, resorcin and/or its derivatives, cresol compounds, chlorine-substituted phenols, monochloroacetic acid, dichloroacetic acid, and trifluoroacetic acid, with preference given to resorcin and p-chlorophenol.

In the underlayer, various gelatin hardeners can be used. Example gelatin hardeners include, for example, aldehyde compounds, such as formaldehyde and glutaraldehyde; bis (2-chloroethylurea), 2-hydroxy-4,6-dichloro-1,3,5-triazine; active halogen compounds described, for example, in U.S. Pat. Nos. 3,288,775 and 2,732,330, and British Patent No. 974,723 and 1,167,207; divinyl sulfone, 5-acetyl-1,3-diacryloylhexahydro-1,3,5-triazine; compounds having a reactive olefin, as described, for example, in U.S. Pat. Nos. 3,635,718 and 15 3,232,763 and British Patent No. 994,869; N-hydroxymethylphthalimide; N-methylol compounds described, for example, in U.S. Pat. Nos. 2,732,316 and 2,586,168; isocyanates described, for example, in U.S. Pat. No. 3,103,437; aziridine compounds described, for example, in U.S. Pat. Nos. 3,017,280 and 2,983,611; acid derivatives described, for example, in U.S. Pat. Nos. 2,725,294 and 2,725,295; epoxy compounds described, for example, in U.S. Pat. No. 3,091,537; and halogencarboxyaldehydes, such as mucochloric acid. An inorganic hardener can also be used, and examples are chromium alum and zirconium sulfate, as well as carboxyl group active-type hardeners described, for example, in JP-B Nos. 12853/1981 and 32699/1983, Belgian Patent No. 825,726, JP-A No. 225148/1985, JP-B No. 50699/1983, JP-A No. 54427/1987, and U.S. Pat. No. 3,321,313, can also be mentioned. The underlayer for use in the present invention can contain, as a matting agent, inorganic fine particles, for example, of silicon dioxide or titanium dioxide, or polymethyl methacrylate copolymer fine particles.

The underlayer for use in the present invention can be coated by a known coating method.

As a silver halide used in the present invention, one having any composition can be used, such as silver chloride, silver chlorobromide, silver chloroiodobromide, pure silver bromide, or silver iodobromide. To the silver halide emulsion used in the present invention, can be added a sensitizing dye, a plasticizer, an antistatic agent, a surface-active agent, a hardening agent, etc.

The silver halide may have either a uniform crystal structure, a structure whose inner and outer parts are different in halogen composition, a layered structure, a structure having epitaxially joined silver halides different in composition, or a structure joined to a compound other than a silver halide, such as silver rhodanide or lead oxide.

Further, a mixture of particles having different crystal forms may be used.

As the silver halide emulsion, usually one that has been physically ripened, chemically ripened, and spectrally sensitized is used. The efficiency of the present invention is particularly remarkably recognized when use is made of an emulsion that has been sensitized with a gold compound and a sulfur-containing compound. Additives used in such a process are described in Research Disclosure Nos. 17,643 and 18,716, and the corresponding sections are described below.

Further, known photographic additives that can be used in the present invention, are also described in the above two Research Disclosures, and the relating sections are also shown below.

| Kind of Additive | RD 17643 | RD 18716 |
|---|---|---|
| 1 Chemical sensitizers | p. 23 | p. 648 (right column) |
| 2 Sensitivity-enhancing agents | — | p. 648 (right column) |
| 3 Spectral sensitizers and Supersensitizers | pp. 23–24 | pp. 648 (right column)–649 (right column) |
| 4 Brightening agents | p. 24 | — |
| 5 Antifogging agents and Stabilizers | pp. 24–25 | p. 649 (right column) |
| 6 Light absorbents, Filter dyes and Ultraviolet absorbents | pp. 25–26 | p. 649 (right column)–650 (left column) |
| 7 Stain-preventing agents | p. 25 (right column) | p. 650 (left to right column) |
| 8 Color image stabilizers | p. 25 | — |
| 9 Film hardeners | p. 26 | p. 651 (left column) |
| 10 Binders | p. 26 | p. 651 (left column) |
| 11 Plasticizers | p. 27 | p. 650 (left column) |
| 12 Coating aids and Surface-active agents | pp. 26–27 | p. 650 (right column) |

In order to subject the silver-halide-rolled silver halide photographic light-sensitive material according to the present invention to a development treatment, developers described, for example, by T. H. James in *The Theory of the Photographic Process*, Fourth Edition, pages 291 to 334, and in *Journal of the American Chemical Society*, Vol. 73, page 3,100 (1951), can be used.

The light-sensitive material for which the particulate polymer of the present invention is used includes, for example, color negative films, color reversal films, black-and-white films for amateurs, and radiographic films, and preferably the particulate polymer of the present invention is used for color negative films.

The particulate photographic polymer of the present invention exhibits excellent effects; that is, it is excellent in dispersion stability in a dispersion medium, it does not allow settling (sedimentation) and aggregation to take place easily, it prevents mat pinholes from being formed after the application, and it can increase the graininess (granularity) of images.

EXAMPLE

Now, the present invention is described in more detail with reference to the following example, which is not to be construed as limiting the present invention.

Color negative light-sensitive materials were prepared according to Example 1 in JP-A No. 219134/1995, except that various water-insoluble matting agents (particulate polymers of the present invention), as shown in Table 4 below, were used in the protective layer, and that the soluble matting agent (a methacrylic acid/methacrylic acid copolymer (weight ratio: 46/54); number-average particle diameter: 0.5 μm; volume-average particle diameter: 2.3 μm; and deviation coefficient: 1.90) was used in an amount of 0.06 g/m$^2$, thereby preparing Samples 101 to 109.

Each of the thus-prepared light-sensitive materials was cut into pieces 24 mm in width and 160 cm in length, and each piece was formed with two 2-mm square perforations 0.7 mm away from one longitudinal side, with an interval of 5.8 mm between the perforations. Each of the two sets was provided with two 32-mm square perforations, with an interval of 5.8 mm between them. The pieces, each of which was prepared with provided the above two sets of perforations placed with an interval of 32 mm between them, were housed in a plastic film magazine (cartridge) illustrated in FIGS. 1 to 7 of U.S. Pat. No. 5,296,887.

Using a head having a head gap of 5 μm and capable of inputting a turn number of 2,000, FM signals were recorded on the sample between the perforations of the light-sensitive material from the side, where the magnetic recording layer was applied, at a feeding speed of 1,000/s.

After the recording of the FM signals, the emulsion surface was exposed to light throughout uniformly at 1,000 cms; respective treatments were carried out in the below-given various ways; and it was housed again in the original plastic film magazine.

The Samples 101 to 109 were cut into strips 35 mm in width, and photographing with them by a camera was carried out, and they were subjected to the following processes at 1 m$^2$/day for 15 days (running process).

Each of the processing steps was performed using an autoprocessor FP-360B (manufactured by Fuji Photo Film Co., Ltd.), with the proviso that the autoprocessor was remodeled so that an overflow solution from the bleaching bath would not be flowed to the next bath, but would be discharged to a waste tank. Further, the autoprocessor FP-360B has a means for correcting evaporation, as described in Kokai-giho No. 94-4992 (Hatsumei-Kyokai).

The processing steps were as follows.

| Processing step | Processing time | Processing temperature | Replenisher* | Tank Volume |
|---|---|---|---|---|
| Color developing | 3 min 5 sec | 38.0° C. | 20 ml | 17 liter |
| Bleaching | 50 sec | 38.0° C. | 5 ml | 5 liter |
| Fixing (1) | 50 sec | 38.0° C. | — | 5 liter |
| Fixing (2) | 50 sec | 38.0° C. | 8 ml | 5 liter |
| Washing | 30 sec | 38.0° C. | 17 ml | 3.5 liter |
| Stabilizing (1) | 20 sec | 38.0° C. | — | 3 liter |
| Stabilizing (2) | 20 sec | 38.0° C. | 15 ml | 3 liter |
| Drying | 1 min 30 sec | 60° C. | | |

Note: *Replenishing amount per 1.1 m of the light-sensitive material having 35-mm width (equivalent to one 24Ex.)

Stabilizing was carried out in a countercurrent mode from tank (2) to tank (1). Overflow solution from washing was all introduced into fixing bath (2). Further, fixing was carried out in a countercurrent piping system connecting two tanks from (2) to (1). Further, the carried over amount of color developer to the bleaching step, the carried over amount of bleaching solution to the fixing step, and the carried over amount of fixing solution to the washing step were respectively 2.5 ml, 2.0 ml, and 2.0 ml, per 1.1 m of the light-sensitive material of a 35 mm width. Each crossover time was 6 sec which was included in the processing time of the preceding step.

Each opening area in the processor were 100 cm$^2$ for the color-developer, 120 cm$^2$ for the bleaching solution, and about 100 cm$^2$ for other processing solutions, respectively.

The composition of each processing solution was as follows, respectively:

| (Color-developer) | Tank Solution (g) | Reple-nisher (g) |
|---|---|---|
| Diethylenetriaminepentaacetic acid | 2.0 | 2.0 |
| 1-Hydroxyethylidene-1,1-diphosphonic acid | 2.0 | 2.0 |
| Sodium sulfite | 3.9 | 5.3 |
| Potassium carbonate | 37.5 | 39.0 |
| Potassium bromide | 1.4 | 0.4 |
| Potassium iodide | 1.3 mg | — |
| Disodium-N,N-bis(sulfonatoethyl)-hydroxylamine | 2.0 | 2.0 |
| Hydroxylamine sulfate | 2.4 | 3.3 |
| 2-Methyl-4-[N-ethyl-n-(β-hydroxyethyl)-amino]aniline sulfate | 4.5 | 6.4 |
| Water to make | 1.0 liter | 1.0 liter |
| pH | 10.05 | 10.18 |
| (pH was adjusted by potassium hydroxide and sulfuric acid) | | |

| (Bleaching solution) | Tank solution (g) | Reple-nisher (g) |
|---|---|---|
| 1,3-Diaminopropanetetraacetate Fe (III) ammonium monohydrate | 118 | 180 |
| Ammonium bromide | 80 | 115 |
| Ammonium nitrate | 14 | 21 |
| Succinic acid | 40 | 60 |
| Maleic acid | 33 | 50 |
| Water to make | 1.0 liter | 1.0 liter |
| pH | 4.4 | 4.0 |
| (pH was adjusted by aqueous ammonia) | | |

| (Fixing solution) | Tank solution (g) | Reple-nisher (g) |
|---|---|---|
| Ammonium methanesulfinate | 10 | 30 |
| Ammonium methanethiosulfonate | 4 | 12 |
| Aqueous ammonium thiosulfate solution (700 g/liter) | 280 ml | 840 ml |
| Imidazole | 7 | 20 |
| Ethylenediaminetetraacetic acid | 15 | 45 |
| Water to make | 1.0 liter | 1.0 liter |
| pH | 7.4 | 7.45 |
| (pH was adjusted by aqueous ammonia and acetic acid) | | |

| (Washing water) |
|---|
| Tap water was treated by passage through a mixed bed ion-exchange column filled with H-type strong acidic cation exchange resin (Amberlite IR-120B, trade name, made by Rohm & Haas) and OH-type strong basic anion exchange resin (Amberlite IR-400, the same as the above) so that the concentrations of Ca ions and Mg ions in water were both made to decrease to 3 mg/liter or below, followed by adding 20 mg/liter of sodium dichlorinated isocyanurate and 150 mg/liter of sodium sulfate. The pH of this water was in the range of 6.5 to 7.5. |

| (Stabilizing solution) (Both tank solution and replenisher) | (g) |
|---|---|
| Sodium p-toluene sulfinate | 0.03 |
| Polyoxyethylene-p-monononylphenylether (av. polymerization degree: 10) | 0.2 |
| Disodium ethylenediaminetetraacetate | 0.05 |
| 1,2,4-Triazole | 1.3 |
| 1,4-Bis(1,2,4-triazole-1-ylmethyl)piperazine | 0.75 |
| 1,2-Benzoisothiazoline-3-one | 0.10 |
| Water to make | 1.0 liter |
| pH | 8.5 |

With respect to the obtained samples, the following evaluations were made.

1) Adhesion Resistance Test

After each of the samples was subjected to a usual development treatment using a suspension-type processor, the sample was cut into 35-mm square pieces; the pieces were allowed to represent 2 hours under an atmosphere of 25° C. and 85% RH; the pieces were put together with the face where the emulsion was applied placing on the back surface; and they were sealed and were stored for 24 hours at 40° C. with a load of 500 g kept placed on them. Thereafter, they were separated, and the occurrence of adhered marks was visually evaluated. "⊙" designates a level free from adhered marks; "○" designates a slight adhered marks that are almost free from any problem; "Δ" designates a few, allowable adhered marks; "x " designates a conspicuous adhered marks, and "xx" designates a severe outstanding adhered marks. "Δ" or a better result is an acceptance level.

2) Evaluation of Granularity

In order to measure the granularity for Samples 101 to 109, a pattern for usually performed RMS measurement was printed in, followed by development, and with respect to the obtained RMS pattern, the microdensity was measured with a V (visual) filter, to calculate the RMS value. The smaller the number, the better the granularity.

If RMS$\times 10^3$ was 0 to 5, it was assigned "⊙"; if RMS$\times 10^3$ was greater than 5 but to 10, it was assigned "○"; if RMS$\times 10^3$ was greater than 10 but to 15, it was assigned "x", and if RMS$\times 10^3$ was greater than 15, it was assigned "xx". "○" and "⊙" are acceptable levels.

3) Peeling-off Test of Matting Agent

The peeling-off of the matting agent by a draining rubber (rubber lip) in processing for motion picture film was tested using a model system shown below.

After the sample was dipped for 5 min in the above color developer (38° C.), a rubber lip for processing of motion picture film, having a width of 12 mm, was rubbed against the surface, with a load of 200 g applied. This was repeated ten times at a rate of 1.8 m/min. The sample was washed with water, and the surface was dried and was observed under an SEM, to evaluate the degree of the peeling-off of the matting agent. "⊙" designates no change; "○" designates a slight change, which is insignificant; "Δ" designates a slightly peeled-off state, which is acceptable; "x" designates a peeled-off state, and "xx" designates a severely peeled-off state. "Δ" or a better result is an acceptable level.

4) Safety Test of Coating Solution

The coating solution containing the matting agent was allowed to stand at 40° C. for 48 hours, to find the settled amount.

When the settled amount was 0 to 5%, it was assigned "○"; when the settled amount was greater than 5 to 15%, it was assigned "Δ"; when the settled amount was greater than 15 to 30%, it was assigned "x ", and when the settled amount was greater than 30%, it was assigned "xx". "Δ" or a better result (smaller amounts) is an acceptable level.

The results are summarized in Table 4.

TABLE 4

| Sample | Matting agent | Added amount mg/m² | Performance: Adhesion resistance | Granularity | Peeling off | Settled amount of matting agent: with standing a coating solution | Remarks |
|---|---|---|---|---|---|---|---|
| 101 | P-1 | 60 | ⊙ | ○ | ⊙ | ○ (3%) | This invention |
| 102 | P-2 | 60 | ⊙ | ○ | ⊙ | ○ (2%) | This invention |
| 103 | P-4 | 60 | ⊙ | ○ | ○ | ○ (4%) | This invention |
| 104 | P-5 | 60 | ⊙ | ○ | ⊙ | ○ (2%) | This invention |
| 105 | P-6 | 60 | ⊙ | ○ | ⊙ | ○ (1%) | This invention |
| 106 | P-8 | 60 | ⊙ | ⊙ | ⊙ | ○ (2%) | This invention |
| 107 | P-22 | 60 | ⊙ | ⊙ | ⊙ | ○ (2%) | This invention |
| 108 | P-31 | 60 | ⊙ | ⊙ | Δ | Δ (18%) | This invention |
| 109 | *2Comparative particulate | 60 | ⊙ | ○~x | x | x (30%) | Comparative example |

*2Polymethyl methacrylate particulates (D) as described in JP-A No. 230141/1986, having the average particulate diameter of 2.6 μm.

As is shown in Table 4, since settling in the coating solutions is prevented, and at the time of the synthesis aggregation occurs less, showing excellent dispersibility, it is apparent that the granularity of the particulate polymer of the present invention is favorably excellent.

Having described our invention as related to the present embodiments, it is our intention that the invention not be limited by any of the details of the description, unless otherwise specified, but rather be construed broadly within its spirit and scope as set out in the accompanying claims.

What we claim is:

1. A particulate photographic polymer, at least comprising a repeating unit represented by formula (I):

Formula (I)

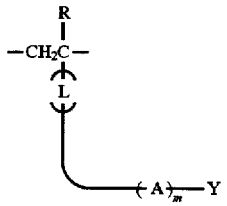

wherein R represents an alkyl group having 1 to 6 carbon atoms, a phenyl group, or a hydrogen atom; L represents a divalent organic binding group; A represents a repeating unit derived from at least one ethylenically unsaturated monomer, with $-(A)_m-$ being soluble in water or a hydrophilic organic liquid, or a repeating unit derived by ring opening polymerization of a nitrogen-containing heterocyclic compound, with $-(A)_m-$ being soluble in water or a hydrophilic organic liquid; m represents the number-average degree of polymerization of 2 or more but 200 or less; and Y represents a monovalent binding groups;

wherein A is at least one repeating unit selected from the group consisting of (i) a repeating unit derived from N-vinylamides, (ii) a repeating unit derived from acrylic acid and methacrylic acid derivatives, (iii) a repeating unit derived from acrylamides, (iv) a repeating unit derived from maleic acids, (v) a repeating unit derived from vinyl alcohol derivatives, (vi) a repeating unit derived from vinyl ethers, (vii) a repeating unit derived by ring opening polymerization of oxazolines, and (viii) a repeating unit derived by ring opening polymerization of 3-membered cyclic imines;

wherein the particulate photographic polymer comprises polymer particulates having an average particulate diameter of 0.5 to 20 μm.

2. The particulate photographic polymer as claimed in claim 1, which is obtained by polymerizing, in a hydrophilic organic liquid, at least one compound represented by formula (III):

Formula (III)

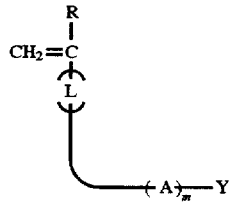

wherein R, L, A, m, and Y each have the same meanings as those of R, L, A, m, and Y in formula (I), and at least one ethylenically unsaturated monomer that is soluble in said hydrophilic organic liquid and whose polymer is insoluble in said hydrophilic organic liquid.

3. The particulate photographic polymer as claimed in claim 1, wherein in formula (I) or (III), A is at least one selected from (i) a repeating unit derived from N-substituted acrylamides, (ii) a repeating unit derived from N-vinylamides, and (iii) a repeating unit derived by ring open polymerization of 2-alkyl-2-oxazolines.

4. The particulate photographic polymer as claimed in claim 1, which comprises polymer particulates having a particulate diameter distribution whose deviation coefficient is 0.25 or less.

5. The particulate photographic polymer as claimed in claim 1, wherein L is selected from $-COOCH_2CH_2S-$, -continued

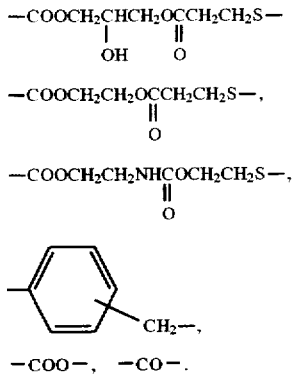

6. The particulate photographic polymer as claimed in claim 1, wherein Y is a hydrogen atom, a halogen atom, or a hydroxyl group.

7. The particulate photographic polymer as claimed in claim 1, wherein m is a number of from 10 to 120.

8. The particulate photographic polymer as claimed in claim 1, wherein A is at least one repeating unit derived from a monomer selected from the group consisting of N-vinylpyrrolidone, N-vinylformamide, acrylic acid, methacrylic acid, β-hydroxyethyl acrylate, β-hydroxyethyl methacrylate, acrylamide, methacrylamide, acryloylmorpholine, acryloylpyrrolidine, N,N-dimethylacrylamide, vinyl acetate, 2-methyl-2-oxazoline, 2-ethyl-2-oxazoline, ethyleneimine, 2-methylethyleneimine, and N-acetylethyleneimine.

9. The particulate photographic polymer as claimed in claim 1, wherein the particulate photographic polymer is to be used as a matting agent.

10. A particulate photographic polymer, comprising a polymer represented by formula (II):

Formula (II)

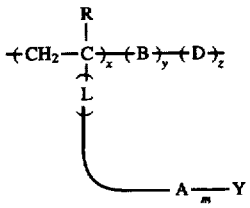

wherein R represents an alkyl group having 1 to 6 carbon atoms, a phenyl group, or a hydrogen atom; L represents a divalent organic binding group; A represents a repeating unit derived from at least one ethylenically unsaturated monomer, with $-(A)_m-$ being soluble in water or a hydrophilic organic liquid, or a repeating unit derived by ring opening polymerization of a nitrogen-containing heterocyclic compound, with $-(A)_m-$ being soluble in water or a hydrophilic organic liquid; m represents the number-average degree of polymerization of 2 or more but 200 or less; Y represents a monovalent binding group; B represents a repeating unit derived from at least one ethylenically unsaturated monomer that is soluble in a hydrophilic organic liquid and whose homopolymer is insoluble in said hydrophilic organic liquid; D represents a repeating unit derived from an ethylenically unsaturated monomer other than the last mentioned ethylenically unsaturated monomer; and x, y, and z represent composition proportions by weight of the respective monomer components, with x being 0.1 to 20% by weight, y being 40 to 99.9% by weight, and z being 0 to 50% by weight;

wherein A is at least one repeating unit selected from the group consisting of (i) a repeating unit derived from N-vinylamides, (ii) a repeating unit derived from acrylic acid and methacrylic acid derivatives, (iii) a repeating unit derived from acrylamides, (iv) a repeating unit derived from maleic acids, (v) a repeating unit derived from vinyl alcohol derivatives, (vi) a repeating unit derived from vinyl ethers, (vii) a repeating unit derived by ring opening polymerization of oxazolines, and (viii) a repeating unit derived by ring opening polymerization of 3-membered cyclic imines;

wherein the particulate photographic polymer comprises polymer particulates having an average particulate diameter of 0.5 to 20 μm.

11. The particulate photographic polymer as claimed in claim 10, which is obtained by polymerizing, in a hydrophilic organic liquid, at least one compound represented by formula (III):

Formula (III)

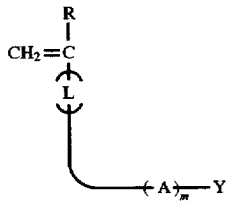

wherein R, L, A, m, and Y each have the same meanings as those of R, L, A, m, and Y in formula (II), and at least one ethylenically unsaturated monomer that is soluble in said hydrophilic organic liquid and whose polymer is insoluble in said hydrophilic organic liquid.

12. The particulate photographic polymer as claimed in claim 10, wherein in formula (II) or (III), A is at least one selected from (i) a repeating unit derived from N-substituted acrylamides, (ii) a repeating unit derived from N-vinylamides, and (iii) a repeating unit derived by ring open polymerization of 2-alkyl-2-oxazolines.

13. The particulate photographic polymer as claimed in claim 10, which comprises polymer particulates having a particulate diameter distribution whose deviation coefficient is 0.25 or less.

14. The particulate photographic polymer as claimed in claim 10, wherein L is selected from

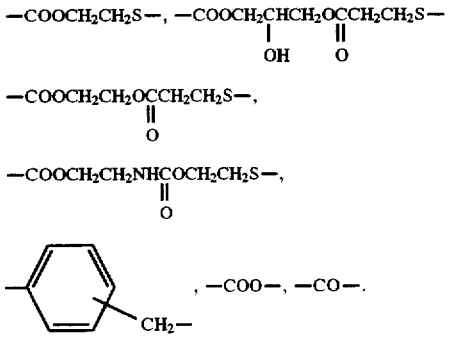

15. The particulate photographic polymer as claimed in claim 10, wherein Y is a hydrogen atom, a halogen atom, or a hydroxyl group.

16. The particulate photographic polymer as claimed in claim 10, wherein m is number of from 10 to 120.

17. The particulate photographic polymer as claimed in claim 10, wherein A is at least one repeating unit derived from a monomer selected from the group consisting of N-vinylpyrrolidone, N-vinylformamide, acrylic acid, methacrylic acid, β-hydroxyethyl acrylate, β-hydroxyethyl methacrylate, acrylamide, methacrylamide, acryloylmorpholine, acryloylpyrrolidine, N,N-dimethylacrylamide, vinyl acetate, 2-methyl-2-oxazoline, 2-ethyl-2-oxazoline, ethyleneimine, 2-methylethyleneimine, and N-acetylethyleneimine.

18. The particulate photographic polymer as claimed in claim 10, wherein the particulate photographic polymer is to be used as a matting agent.

* * * * *